US007589676B2

(12) United States Patent
Popugaev et al.

(10) Patent No.: US 7,589,676 B2
(45) Date of Patent: Sep. 15, 2009

(54) APERTURE-COUPLED ANTENNA

(75) Inventors: Alexander Popugaev, Erlangen (DE); Rainer Wansch, Hagenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 131 days.

(21) Appl. No.: 11/844,520

(22) Filed: Aug. 24, 2007

(65) Prior Publication Data

US 2007/0296634 A1 Dec. 27, 2007

Related U.S. Application Data

(63) Continuation of application No. PCT/EP2006/001056, filed on Feb. 7, 2006.

(30) Foreign Application Priority Data

Mar. 9, 2005 (DE) ..... 10 2005 010 895

(51) Int. Cl.
*H01Q 1/38* (2006.01)

(52) U.S. Cl. ..... 343/700 MS

(58) Field of Classification Search ..... None
See application file for complete search history.

(56) References Cited

U.S. PATENT DOCUMENTS

| | | | | |
|---|---|---|---|---|
| 4,903,033 | A * | 2/1990 | Tsao et al. | 343/700 MS |
| 5,633,645 | A | 5/1997 | Day | |
| 5,952,971 | A | 9/1999 | Strickland | |
| 6,008,763 | A | 12/1999 | Nystrom et al. | |
| 6,018,319 | A | 1/2000 | Lindmark | |
| 6,288,679 | B1 * | 9/2001 | Fischer et al. | 343/700 MS |
| 7,382,320 | B2 * | 6/2008 | Chang et al. | 343/700 MS |
| 7,471,248 | B2 * | 12/2008 | Popugaev et al. | 343/700 MS |
| 2002/0171595 | A1 | 11/2002 | Schultze et al. | |

(Continued)

FOREIGN PATENT DOCUMENTS

EP 0 700 117 A1 3/1996

(Continued)

OTHER PUBLICATIONS

Official communication issued in counterpart International Application No. PCT/EP2006/001056, mailed on May 26, 2006.

(Continued)

*Primary Examiner*—Trinh V Dinh
(74) *Attorney, Agent, or Firm*—Keating & Bennett, LLP

(57) ABSTRACT

An aperture-coupled antenna has a first radiation electrode, a ground area and a wave guide which is implemented to supply energy to the antenna. The wave guide is arranged spaced apart from the ground area on a first side of the ground area, and the first radiation electrode is arranged spaced apart from the ground area on a second side of the ground area. The ground area has an aperture including a first slot in the ground area, a second slot in the ground area and a third slot in the ground area. The first slot and the second slot together form a slot in the shape of a cross. The third slot passes through an intersection of the first slot and the second slot. The wave guide and the radiation electrode are arranged such that energy can be coupled from the wave guide through the aperture to the patch.

21 Claims, 8 Drawing Sheets

U.S. PATENT DOCUMENTS

| | | | | |
|---|---|---|---|---|
| 2003/0052825 | A1 | 3/2003 | Rao et al. | |
| 2003/0137464 | A1* | 7/2003 | Foti et al. | 343/770 |
| 2004/0027292 | A1 | 2/2004 | Gabriel et al. | |
| 2004/0239567 | A1 | 12/2004 | Van Der Poel | |
| 2005/0225498 | A1 | 10/2005 | Koparan et al. | |
| 2006/0012524 | A1 | 1/2006 | Mierke et al. | |

FOREIGN PATENT DOCUMENTS

| | | | |
|---|---|---|---|
| EP | 1 072 065 | B1 | 3/2002 |
| EP | 0 939 975 | B1 | 10/2003 |
| EP | 1 006 608 | B1 | 5/2004 |

OTHER PUBLICATIONS

Choi et al.: "Compact Size IMT-2000 Microstrip Antenna for Repeater and Base Stations," IEEE Antennas and Propogation Society International Symposium; Jul. 2001, pp. 34-37.

Huang et al.: "Slot-Coupled Microstrip Antenna for Broadband Circular Polarisation," Electronics Letters; Apr. 30, 1998; vol. 34, No. 9; 2 pages.

Chiou et al.: "A Compact Dual-Band Dual Polarized Patch Antenna for 900/1800-MHz Cellular Systems," IEEE Transactions on Antennas and Propagation; vol. 51, No. 8; Aug. 2003, pp. 1936-1940.

Sanchez-Hernandez et al.: "A Survey of Broadband Microstrip Patch Antennas," Microwave Journal, Sep. 1996; pp. 60-84.

Wong: "Planar Antennas for Wireless Communications," Wiley-Interscience; Jan. 2003; pp. 203-263.

Pozar: "A Review of Aperture Coupled Microstrip Antennas: History, Operation, Development, and Applications," May 1996; www.ecs.umass.edu/ece/pozar/aperature.pdf; 12 pages.

Zurcher et al.: "Broadband Patch Antennas," SSFIP Principle; Chapter 3; Artech House, Boston, London; Mar., 1995; pp. 45-61.

Jung et al.: "A Dual-Band Antenna for WLAN Applications by Double Rectangular Patch Wtih 4-Bridges," Antennas and Propogation Society International Symposium IEEE; Department of Electrical Engineering and Computer Science, University of California; Jun. 2004.

Pozar et al.: "A Dual-Band Circularly Polarized Aperture-Coupled Stacked Microstrip Antenna for Global Positioning Satellite," IEEE Transactions on Antennas and Propagation, vol. 45, No. 11; Nov. 1997; pp. 1618-1625.

Wiesmann: Diploma Thesis "Examination and Setup of Multi-Band Antennas for Receiving of Circularly Polarized Signals," Friedrich-Alexander-Universitat, Erlangen-Nurnberg; Dec. 17, 2002; 109 pages.

Pozar: "Microstrip Antenna Aperture-Coupled to a Microstripline," Electronic Letters, Jan. 1985, vol. 21, No. 2; pp. 49-50.

Pozar: "A Reciprocity Method of Analysis for Printed Slot and Slot-Coupled Microstrip Antennas," IEEE Transactions on Antennas and Propagation; Dec. 1986; vol. AP-34, No. 12; pp. 1439-1446.

Sullivan et al.: "Analysis of an Aperture Coupled Microstrip Antenna," IEEE Transactions on Antennas and Propagation; Aug. 1986; vol. AP-34, No. 8; pp. 977-984.

Adrian et al.: "Dual Aperture-Coupled Microstrip Antenna for Dual or Circular Polarisation," Electronics Letters; Nov. 5, 1987; vol. 23, No. 23; pp. 1226-1227.

Gao et al.: "Network Modeling of an Aperture Coupling Between Microstrip Line and Patch Antenna for Active Array Applications," IEEE Transactions on Microwave Theory and Techniques, Mar. 1988; vol. MTT-36, No. 3; pp. 505-513.

Tsao et al.: "Aperture Coupled Patch Antennas With Wide-Bandwidth and Dual-Polarization Capabilities," IEEE Antennas and Propagation Symposium Digest, 1988, pp. 936-939.

Zurcher: "The SSFIP: A Global Concept for High-Performance Broadband Planar Antennas," Electronics Letters; Nov. 10, 1988; vol. 24, No. 23; pp. 1433-1435.

Himdi et al.: "Analysis of Aperture Coupled Microstrip Antenna Using Cavity Method," Electronics Letters; Mar. 16, 1989; vol. 25, No. 6; pp. 391-392.

Himdi et al.: "Transmission Line Analysis of Aperture-Coupled Microstrip Antenna," Electronics Letters; Aug. 31, 1989; vol. 25, No. 18; pp. 1229-1230.

Pozar: "Analysis of an Infinite Phased Array of Aperture Coupled Microstrip Patches," IEEE Transactions on Antennas and Propogation; Apr. 1989; vol. AP-37, No. 4; pp. 418-425.

Croq et al.: "Large Bandwidth Aperture-Coupled Microstrip Antenna," Electronics Letters, Aug. 2, 1990; vol. 26, No. 16; pp. 1293-1294.

Croq et al.: "Millimeter-Wave Design of Wide-Band Aperture-Coupled Stacked Microstrip Antennas," IEEE Transactions on Antennas and Propagation; Dec. 1991; vol. 39, No. 12; pp. 1770-1776.

Croq et al.: "Stacked Slot-Coupled Printed Antenna," IEEE Microwave and Guided Wave Letters; Oct. 1991; vol. 1, No. 10; pp. 288-290.

Ittipiboon et al.: "A Modal Expansion Method of Analysis and Measurement on Aperture-Coupled Microstrip Antenna," IEEE Transactions on Antennas and Propagation; Nov. 1991; vol. AP-39, No. 11; pp. 1567-1574.

Wu et al.: "Study on Series-Fed Aperture-Coupled Microstrip Patch Array," IEEE; 1990; pp. 1762-1765.

Edimo et al.: "Optimised Feeding of Dual Polarised Broadband Aperture-Coupled Printed Antenna," Electronics Letters; Sep. 1992; vol. 28, No. 19; pp. 1785-1787.

Ohmine et al.: "An MMIC Aperture-Coupled Microstrip Antenna in the 40GHz Band," Proceedings of ISAP, 1992, pp. 1105-1108.

Pan et al.: "Computation of Mutual Coupling Between Slot-Coupled Microstrip Patches in a Finite Array," IEEE Transactions on Antennas and Propagation; Sep. 1992; vol. 40, No. 9; pp. 1047-1053.

Yazidi et al.: "Transmission Line Analysis of Nonlinear Slot Coupled Microstrip Antenna," Electronics Letters; Jul. 16, 1992, vol. 28, No. 15; pp. 1406-1408.

Dich et al.: "A Network Model for the Aperture Coupled Microstrip Patch," International Journal of Microwave and Millimeter-Wave Computer-Aided Engineering, 1993; vol. 3, No. 4; pp. 326-339.

Targonski et al.: "Design of Wideband Circularly Polarized Aperture-Coupled Microstrip Antennas," IEEE Transactions on Antennas and Propagation; Feb. 1993; vol. 41, No. 2; pp. 214-220.

Edimo et al.: "Wideband Dual Polarised Aperture-Coupled Stacked Patch Antenna Array Operating in C-Band," Electronics Letters; Jul. 21, 1994; vol. 30, No. 15; pp. 1196-1198.

Simons et al.: "Analysis of Aperture-Coupled Microstrip-Antenna and Circuit Structures Using the Transmission-Line-Matrix Method," IEEE Antennas and Propagation Magazine; Aug. 1995; vol. 37, No. 19; pp. 27-36.

Park et al.: "Aperture-Coupled Small Microstrip Antenna," Electronics Letters; Sep. 12, 1996; vol. 32, No. 19; pp. 1741-1742.

Sanford et al.: "A Two Substrate Dual Polarised Aperture Coupled Patch," IEEE International Symposium on Antennas and Propagation; 1996; pp. 1544-1547.

Targonski et al.: "An Aperture Coupled Stacked Patch Antenna With 50% Bandwidth," IEEE International Symposium on Antennas and Propagation; 1996; pp. 18-21.

Vlasits et al.: "Performance of a Cross-Aperture Coupled Single Feed Circularly Polarised Patch Antenna," Electronics Letters; Mar. 28, 1996; vol. 23, No. 7; pp. 612-613.

Eleftheriades et al.: "ALPSS: A Millimeter-Wave Aperture-Coupled Patch Antenna on a Substrate Lens," Electronics Letters; Jan. 30, 1997; vol. 33, No. 3; pp. 169-170.

Yau et al.: "Numerical Analysis of an Aperture Coupled Microstrip Patch Antenna Using Mixed Potential Integral Equations and Complex Images," Progress in Electromagnetics Research; 1998; pp. 229-244.

Karmakar et al.: "Circularly Polarized Aperture-Coupled Circular Microstrip Patch Antennas for L-Band Applications," IEEE Transactions on Antennas and Propagation; May 1999; vol. 47, No. 5; pp. 933-940.

Kossel et al.: "Circular Polarized Aperture Coupled Patch Antennas for an RFID System in the 2.4 GHz ISM Band," http://www.rawcon.org/rawcon99/slidesW1_2.pdf; 1999, pp. 235-238.

Huang et al.: "Cross-Slot-Coupled Microstrip Antenna and Dielectric Resonator Antenna for Circular Polarization," IEEE Transactions on Antennas and Propagation; Apr. 1999; vol. 47, No. 4; pp. 605-609.
Lu: "Broadband Operation of a Slot-Coupled Compact Rectangular Microstrip Antenna With a Chip-Resistor Loading," Proc. Natl. Sci. Counc. Roc(A); 1999; vol. 23, No. 4; pp. 550-554.
Jung: "Electromagnetically Coupled Rectangular Patch Microstrip Antenna for Circular Polarization," Proceedings of the 1999 Graduate Studies Conference, Gradcon'99; Oct. 1, 1999; 1 page.
Chung et al.: "A Broadband Singly-Fed Electromagnetically Coupled Patch Antenna for Circular Polarisation," Faculty of Engineering, Telecommunications Group Cooperative Research Centre for Satellite Systems; University of Technology; 2000; 5 pages.
Koers et al.: "Large Aprture Coupled Microstrip Patch Antenna Arrays: Proposal for the Opto-Electronic Control of Micro and MM-Wave Radiation?" Vrije Universiteit Brussel; Lab for Micro- and Optoelectronics Department; 2000; 4 pages.
Pozar et al.: "A Comparison of Commercial Software Packages for Microstrip Antenna Analysis," 2000; http://www.anteg.net/tuli/paperspdf/conference/20-APS-Saltlake-2000.pdf; 4 pages.
Wu et al.: "Design and Characterization of Single and Multiple Beam MM-Wave Circularly Polarized Substrate Lens Antennas for Wireless Communications," IEEE Transactions on Microwave Theory and Techniques; 2001; vol. 49, No. 3; pp. 2408-2411.
Prata Jr.: "Misaligned Antenna Phase-Center Determination Using Measured Phase Patterns," IPN Progress report; Aug. 15, 2002; pp. 1-9.
Kabacik et al.: "A Circularly Polarized Antenna Element for Highly Integrated Array Antennas," University of Technology, Poland, 2003; 2 pages.
Popugaev et al.: "Planar Multiband Antenna," U.S. Appl. No. 11/844,530, filed Aug. 24, 2007.

* cited by examiner

APERTURE-COUPLED ANTENNA

CROSS-REFERENCE TO RELATED APPLICATIONS

This application is a continuation of copending International Application No. PCT/EP2006/001056, filed Feb. 7, 2006, which designated the United States and was not published in English.

BACKGROUND OF THE INVENTION

1. Field of the Invention

The present invention generally relates to an aperture-coupled antenna, particularly to an aperture-coupled circularly polarized planar antenna.

2. Description of the Related Art

Wireless systems which have to function in several frequency bands are being developed more frequently. Frequently, compact antennas are necessary to keep the setup volume of the antennas small and to allow usage in portable devices.

It is possible to provide a separate antenna for each frequency band to be used. The disadvantage of using separate antennas, however, is that a multiplexer has to be employed. In addition, the area necessary for the antennas increases when using separate antennas.

Receiving from several different wireless transfer systems by a single broadband antenna is problematic since broadband antennas cannot usually be manufactured at low cost in a compact design. If all the relevant systems are to be received by a single broadband antenna, this will not be possible using a small cheap antenna.

A multi-element antenna having a special radiator for every frequency range can be used for receiving several frequency bands. Most antenna concepts known which are suitable for receiving from two or more frequency bands (dual-band concept and/or multiband concept) and which can be used for and/or in patch antennas, such as, for example, integrated inverted-F antennas (IFAs) and planar inverted-F antennas (PIFAs), comprise only a linear polarization. Well-known antenna shapes of this kind are, for example, described in the book "Planar Antennas for Wireless Communications" by Kin-Lu Wong (John Wiley & Sons, Inc., Hoboken, N.J., 2003).

However, it is desirable in particular for mobile applications to use a circular polarization, since in this case the orientation of transmitting and receiving antennas is uncritical, whereas when using linear polarization, the orientation of the antennas has to be selected appropriately.

A series of antennas which may be integrated comprising a circular polarization are known, however many of the geometries which may be integrated comprise essential disadvantages for generating a circular polarization. Exemplarily, nearly squared patches (planar conductive areas) of coaxial feeding have a low impedance bandwidth, as is, for example, described in the dissertation "Untersuchung und Aufbau von Multibandigen Antennen zum Empfang zirkular polarisierter Signale" by U. Wiesman produced in 2002 at the Fraunhofer-Institut für integrierte Schaltungen in Erlangen. The same is true for aperture-coupled patch antennas having a cross-slot which are described in the master paper having the title "Untersuchung zirkular polarisierter Patchantenne mit Aperturkopplung" by A. Popugaev in 2004 for Fraunhofer Institut für integrierte Schaltungen in Erlangen. All in all, it can be stated that the polarization purity in known broadband circularly polarized patch antennas having only one feeding point is low. On the other hand, spiral antennas exhibit great losses.

An overview of aperture-coupled microstrip antennas can be found in the article "A review of aperture coupled microstrip antennas: history, operation, development and applications" by D. M. Pozar, published in May 1996 at the University of Massachusetts at Amherst and is available on the internet under www.ecs.umass.edu/ece/pozar/aperture.pdf. Further information on the topic of broadband patch antennas can be found in the book "Broadband Patch Antennas" by J.-F. Zuercher published in 1995 by the Artech-House Verlag.

In summary, it can be stated that there is no technologically advantageous antenna design which, with good radiation efficiency and sufficient impedance bandwidth, allows circularly polarized waves to be radiated with high orthogonal polarization suppression. In addition, there is no known technologically simple antenna design which can be realized at low cost which, with good efficiency and sufficient bandwidth, allows a circularly polarized electromagnetic wave to be radiated in two different frequency bands.

SUMMARY OF THE INVENTION

According to an embodiment, an aperture-coupled antenna may have: a first radiation electrode the geometrical shape of which is implemented to allow radiation of a circularly polarized electromagnetic wave; a ground area; and a wave guide which is implemented to supply energy to the antenna, wherein the wave guide is arranged spaced apart from the ground area on a first side of the ground area, and wherein the first radiation electrode is arranged spaced apart from the ground area on a second side of the ground area; wherein the ground area has an aperture including a first slot in the ground area, a second slot in the ground area and a third slot in the ground area, wherein the first slot and the second slot together form a slot in the shape of a cross, wherein the third slot passes through an intersection of the first slot and the second slot; wherein additionally the wave guide and the first radiation electrode are arranged such that energy can be coupled from the wave guide through the aperture to the first radiation electrode; wherein the third slot is implemented such that an operating frequency for which the aperture-coupled antenna is designed deviates by at most 30% from a resonant frequency of the third slot; and wherein the length of the first slot and the length of the second slot differ from the length of the third slot to allow the third slot at the operating frequency to be operated nearer to its resonance than the first slot and the second slot.

Embodiments of the present invention provide an aperture-coupled antenna comprising a first radiation electrode, a ground area and a wave guide implemented to supply energy to the antenna. The wave guide is arranged spaced apart from the ground area on a first side of the ground area, and the radiation electrode is arranged spaced apart from the ground area on a second side of the ground area. The ground area comprises an aperture including a first slot in the ground area, a second slot in the ground area and a third slot in the ground area, wherein the first slot and the second slot together form a slot in the shape of a cross, and wherein the third slot passes an intersection of the first slot and the second slot. The geometrical shape of the radiation electrode is implemented to allow radiation of a circularly polarized electromagnetic wave. For this purpose, the radiation electrode has a disturbed geometry. Exemplarily, the radiation electrode can be nearly squared with slightly different dimensions and/or edge lengths. Also, the radiation electrode can be rectangular and/or nearly squared, wherein at least one corner is bevelled.

Finally, the radiation electrode can also comprise slots which are implemented to allow radiation of a circularly polarized wave. However, any other geometry of the radiation electrode is also possible as long as it allows circular polarization. In addition, in an inventive antenna, the wave guide and the radiation electrode are arranged such that energy can be coupled from the wave guide through the aperture to the radiation electrode.

The central idea of embodiments of the present invention is that it is possible to provide an aperture-coupled antenna having particularly advantageous characteristics by coupling energy from a wave guide through an aperture to a radiation electrode, the aperture comprising a combination of three slots. Here, in connection with a radiation electrode of suitable design, circularity of an electromagnetic wave radiated can be improved (i.e. suppression of undesired orthogonal polarization when radiating a circularly polarized wave can be improved) by the fact that two of the slots forming the aperture form a slot in the shape of a cross. The radiation electrode here is to be implemented such that it allows radiation of a circularly polarized wave. Exemplarily, the radiation electrode can comprise a rectangular or squared shape, wherein at least one of the corners is bevelled. A nearly squared radiation electrode having slightly different dimensions and/or edge lengths can also be used. In addition, the radiation electrode can comprise one or several slots which are arranged in the center of the radiation electrode. However, apart from the implementations mentioned, any kind of radiation electrode allowing radiation of a circularly polarized wave may be used. Additionally, the impedance bandwidth of the inventive antenna can be increased by providing a third slot passing through an intersection in which the first and second slots form the center of a cross in which the first and second slots intersect and/or overlap.

By introducing a third slot, a new degree of freedom for the designer has been provided, allowing designing the antenna to be such that the greatest possible impedance bandwidth can be achieved. Impedance bandwidth here is to indicate a bandwidth within which antenna matching is so good that a predetermined standing wave ratio (SWR) is not exceeded.

It is particularly amazing here that introducing a third slot does not considerably deteriorate the polarization characteristics of the aperture-coupled antenna. It might be expected according to known results that a circular polarization which is excited due to the presence of two slots which together form the shape of a cross is strongly impeded by adding another slot so that the polarization orthogonal thereto increases significantly. In contrast to what would be expected, it has shown that, even when using three slots, very high suppression of undesired polarization can be obtained. This is all the more surprising in that, according to conventional conception, two mutually orthogonal modes must be excited with a suitable phase shift in order to achieve circular polarization with a small portion of a polarization orthogonal thereto. Thus, it is surprising for those skilled in the art that, when there are three slots forming an aperture, but of course cannot all be orthogonal to each other, nevertheless circular polarization having a low portion of polarization orthogonal thereto can be achieved.

The advantage of an embodiment of the present invention is that a planar antenna having circular polarization, offering good suppression of polarization orthogonal thereto, and at the same time comprising a great impedance bandwidth can be provided. In addition, the inventive antenna can have a completely planar structure, which results in a small structural form and low cost in comparison to conventional antennas. The structure of the antenna can be in conventional technology, wherein only electrically conductive layers forming a radiation electrode and a ground area have to be produced. These conductive structures can, for example, be arranged on dielectric support materials, wherein patterning metallizations using conventional etching technologies appears to be suitable here. Supplying energy to the antenna can be performed by any wave guide structure which is capable of coupling electromagnetic energy through the aperture to the radiation electrode. Thus, very flexible feeding of the inventive antenna is possible. Another advantage of an inventive antenna structure is that dual-band and multiband concepts can be implemented, wherein a circularly polarized electromagnetic wave can be produced in several frequency bands, and wherein the overall size does not exceed the necessary size of the antenna structure for the lowest operating frequency. This is made possible by coupling in electromagnetic energy from the back side of the antenna through an aperture. The size of the radiation electrode here is determined by the operating frequency. Feeding structures and other active and passive elements (exemplarily amplifiers, phase shifters or mixers) can be arranged behind the aperture-coupled antenna and do not increase the area consumption of the entire arrangement. Furthermore, it can be stated that the inventive antenna structure allows keeping losses low by only employing dielectric materials to a limited extent. It is sufficient to mechanically support the radiation electrode, the ground area and, maybe, the wave guide by dielectric support materials. Furthermore, there are no very long and narrow conductor structures in an inventive antenna structure, as are, for example, conventional in spiral antennas. This, too, allows reducing the losses of an inventive antenna.

For reasons of clarity, it is also pointed out that the radiation electrode is a two-dimensional structure, as is usual in aperture-coupled antennas. Such a radiation electrode is in the respective expert literature typically referred to as a "patch". The entire structure of the inventive aperture-coupled antenna thus represents a special case of a patch antenna.

It should also be pointed out that, in aperture-coupled antennas, the ground area is parallel or roughly parallel to the radiation electrode, wherein a deviation from parallelity of up to about 20 degrees may occur. It is also pointed out that an aperture-coupled antenna is set up as a planar antenna, wherein both the radiation electrode and the ground area are planar. Similarly, the wave guide advantageously also is planar. However, curvature of the radiation electrode and ground area is also possible.

In an embodiment of the present invention, the third slot is longer than the first slot and also longer than the second slot. This is of particular advantage since the bandwidth of the antenna can be increased by a third slot which is longer than the first and second slots. This is understandable since the third slot is particular effective in improving the bandwidth of the antenna when it has the greatest possible influence on the electromagnetic field distribution, without causing a deterioration in the separation of mutually orthogonal polarizations.

Additionally, it is of advantage for the first slot and the second slot to be orthogonal to each other and together form a slot in the shape of a rectangular cross having arms of equal length. In this case, the lengths of the two slots are equal and the slots are arranged such that they intersect each other orthogonally in the center. An orthogonal arrangement of the first and second slots is of particular advantage, since this allow obtaining optimum excitation of circular polarization. An orthogonal arrangement of the slots thus has the result that either right-hand or a left-hand circularly polarized wave is excited by the first and second slots. In order to generate an optimum pure polarization, however, the acute angle between the first and second slots may be varied between 70° and 90°. Thus, the antenna structure can be optimized in the presence of the third slot.

Additionally, it is of advantage for the midpoint of the third slot to coincide with a midpoint of the cross-shaped slot formed by the first and second slots. Expressed differently, the first, second and third slots intersect in a common spatial region. Thus, there is only one region in the center of the aperture where the three slots intersect. The three slots form the shape of a star. Furthermore, the arrangement described achieves symmetrical arrangement of the third slot, in the sense that the length of the third slot is, on both sides of the intersection, equal to the first and second slots. This prevents asymmetries from forming in the emissions of the inventive antenna.

Furthermore, a highly symmetrical arrangement is of advantage in which a geometrical midpoint of the first slot, a geometrical midpoint of the second slot and a geometrical midpoint of the third slot coincide, and in which the aperture is axisymmetric relative to an axis of the third slot. The axis of the third slot here is defined along a greatest dimension of the third slot. In the rectangular third slot, the axis shall be defined as a median line of the rectangle parallel to the two longer edges of the rectangle. Such a geometry allows very high symmetry reflected in the radiation behavior of the antenna, in particular in the polarization purity.

Additionally, it is of advantage for the third slot to be orthogonal to the feed line. This arrangement results in a further increase in the symmetry, which in turn allows improving radiation characteristics and polarization purity.

In another embodiment, the first slot and the second slot are implemented such that the first slot and the second slot, in an operating frequency range for which the aperture-coupled antenna is designed, are not operated in resonance. This may, for example, be achieved by a suitable selection of the lengths of the first and second slots. In order to avoid resonance behavior of the first and second slots, they are implemented to be shorter than a predetermined length, wherein the predetermined length is in the order of magnitude of half a free-space wavelength at an operating frequency. Such a measure is of advantage since the first slot and the second slot basically serve to allow the radiation electrode to be excited in such a way that a wave radiated has a circular polarization. Thus, it is not desirable for the first and second slots to be operated near resonance. A resonance occurring in the first and second slots would cause steep changes in the phase, thereby strongly altering polarization relative to frequency. Furthermore, a resonance of the first and second slots also has the result of strong backward radiation, i.e. from the ground area in the direction of the feed line. This should be avoided.

Additionally, it is of advantage for the third slot to be implemented such that an operating frequency for which the aperture-coupled antenna is designed to deviate by at most 30% from a resonance frequency of the third slot. It is thus necessary for the resonant frequency of the slot to differ by at most 30° from an allowable operating frequency. Thus, the third slot is operated near resonance at least one operating frequency for which the antenna is designed. A resonant-type behavior of the third slot, however, in particular has the result that the impedance bandwidth of the inventive antenna improves. When the third slot is operated in resonance, a great amount of electromagnetic energy is stored in the spatial region surrounding the third slot, thereby forming an energy reservoir by means of which reactive impedance portions of the input impedance of the inventive antenna can be compensated. Consequently, operating the third slot near its resonance provides improved impedance matching of the entire inventive aperture-coupled antenna structure.

In another embodiment, the third slot is implemented such that a resonant frequency of the third slot is within an operating frequency range for which the aperture-coupled antenna is designed. In such a design, a maximum improvement in the bandwidth of the inventive antenna can be achieved. At resonant frequency, the region around the third slot stores a maximum amount of electromagnetic energy and can thus achieve maximum influence on the impedance.

Furthermore, it is of advantage for the wave guide through which the antenna is fed to be a microstrip line, a coplanar wave guide, a strip line, a dielectric wave guide or a cavity wave guide. A microstrip line is of particular advantage here since it is easy to realize and can be combined well with active circuits. A coplanar wave guide offers the advantage that no vias are necessary for coupling to a reference potential. A strip line completely embedded in a dielectric offers a particularly advantageous dispersion behavior. Using a dielectric wave guide is, for example, suggested with very high frequencies since metallic losses are avoided in a dielectric wave guide. A cavity wave guide may also serve as a low-loss feed line.

The aperture and the radiation electrode are implemented such that the aperture-coupled antenna, except for parasitic effects, radiates a circularly polarized electromagnetic wave. With regard to the design of the radiation electrode, it is of advantage to use a patch in the shape of a rectangle. A particular advantageous circular radiation will result if the patch is nearly squared, i.e. the lengths of the longer and shorter sides differ by at most 20%. In addition, it is of advantage to cut off corners of the patch having a rectangular shape and/or nearly squared shape, since this allows fixing polarization. A suitable mode allowing radiation of a circularly polarized electromagnetic wave is excited. Here, it is of advantage to cut off two opposite corners. The polarization purity can be influenced by altering geometrical details of the slot aperture, wherein the basic shape of the aperture comprising three slots is maintained.

In another embodiment, the inventive antenna further includes a second planar radiation electrode and a third planar radiation electrode. The second planar radiation electrode is basically arranged to be parallel to the first radiation electrode, wherein the first radiation electrode is arranged between the second radiation electrode and the ground area. An essentially parallel arrangement here means that maximum tilting between the second planar radiation electrode and the first radiation electrode is no more than 20 degrees. The geometrical arrangement is such that the wave guide, the ground area, the first radiation electrode and the second radiation electrode are arranged in this order from the bottom to the top. The first radiation electrode is, in the order of the layers, arranged between the second radiation electrode and the ground area. The expression "between", however, here is no limitation for the size of the electrodes. For planar electrodes, the spatial arrangement is to be taken such that a plane in which the first radiation electrode is located is arranged between a plane in which the second radiation electrode is located and a plane in which the ground are is located. Should the electrodes not be completely planar, the corresponding definition is to be applied only roughly, wherein sufficiently smooth areas in which the respective electrodes are arranged are substituted for the planes.

In addition, in an embodiment of the present invention, the third radiation electrode is arranged such that, in a projection along an axis normal to the second radiation electrode, the third radiation electrode encloses the second radiation electrode. A corresponding definition can roughly be transferred to cases in which the second and third radiation electrodes are not completely planar but have a slight curvature. It is to be defined by this that, in a top view in which the direction of vision corresponds to a mean area normal of the second radiation electrode, the third radiation electrode encloses the second radiation electrode. Such an arrangement which comprises a first radiation electrode and a second and third radiation electrode is suitable for allowing multiband operation of the inventive antenna. At very high frequencies, the first radiation electrode has the effect of an element radiating considerably. The third radiation electrode encloses the second radiation electrode, but there is a gap and/or slot between the two through which radiation can take place emanating from the first radiation electrode. It is again to be pointed out here for better understanding that the second radiation electrode and the third radiation electrode together are typically larger than the first radiation electrode and are in front of the first radiation electrode in the direction of the main radiation. Thus, it is made possible by an inventive arrangement in which a second radiation electrode and a third radiation electrode are separate that the first radiation electrode is still capable of radiating effectively despite a second or third radiation electrode being present.

In another embodiment, the second radiation electrode and the third radiation electrode are in a plane, wherein again the third radiation electrode encloses the second radiation electrode. This arrangement allows particular advantageous common manufacturing of the second and third radiation electrodes which may, for example, be supported by a common substrate. Furthermore, the second and third radiation electrodes can be in strong interaction, thereby effectively forming a radiation electrode which nearly has the same size as the third radiation electrode.

The inventive antenna may be implemented such that impedance matching is obtained with a standing wave ratio of smaller than 2 in at least two frequency bands. Thus, two-band operation and/or multiband operation of the inventive antenna is possible, wherein good matching is achieved. Good matching allows effective coupling of energy to the antenna.

The inventive antenna may be structured in several layers. In an embodiment, the inventive antenna comprises a first dielectric layer, a first layer of low dielectric constant, and a second dielectric layer. The first dielectric layer supports the wave guide on its first surface and the ground area on its second surface. The second dielectric layer supports the first radiation electrode on one side. The layer of low dielectric constant is arranged between the first dielectric layer and the second dielectric layer. The dielectric constant of the first layer of low dielectric constant is smaller than the dielectric constant of the first dielectric layer and lower than the dielectric constant of the second dielectric layer. Such an implementation of an antenna allows particularly easy manufacturing, wherein the radiation characteristics of the antenna are improved by the layers of low dielectric constant. A layer of very low dielectric constant reduces the dielectric losses and also reduces surface waves occurring.

A multiband structure can be achieved by introducing a second layer of low dielectric constant and a third dielectric layer. The third dielectric layer here supports the second radiation electrode and the third radiation electrode. The second layer of low dielectric constant is arranged between the second dielectric layer and the third dielectric layer. The dielectric constant of the second layer of low dielectric constant is smaller than the dielectric constant of the first, second and third dielectric layers.

A particularly easy and cheap manufacturing can be achieved by manufacturing the first, the second and the third dielectric layers from FR4 material (conventional circuit board material). The layer of low dielectric constant may be formed by air. It has been shown that an inventive antenna, with a corresponding design, can be manufactured extremely cheaply, wherein the radiation characteristics are not influenced negatively despite the cheap materials used.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

Embodiments of the present invention will be detailed subsequently referring to the appended drawings, in which.

DETAILED DESCRIPTION OF PREFERRED EMBODIMENTS

Figure 1:
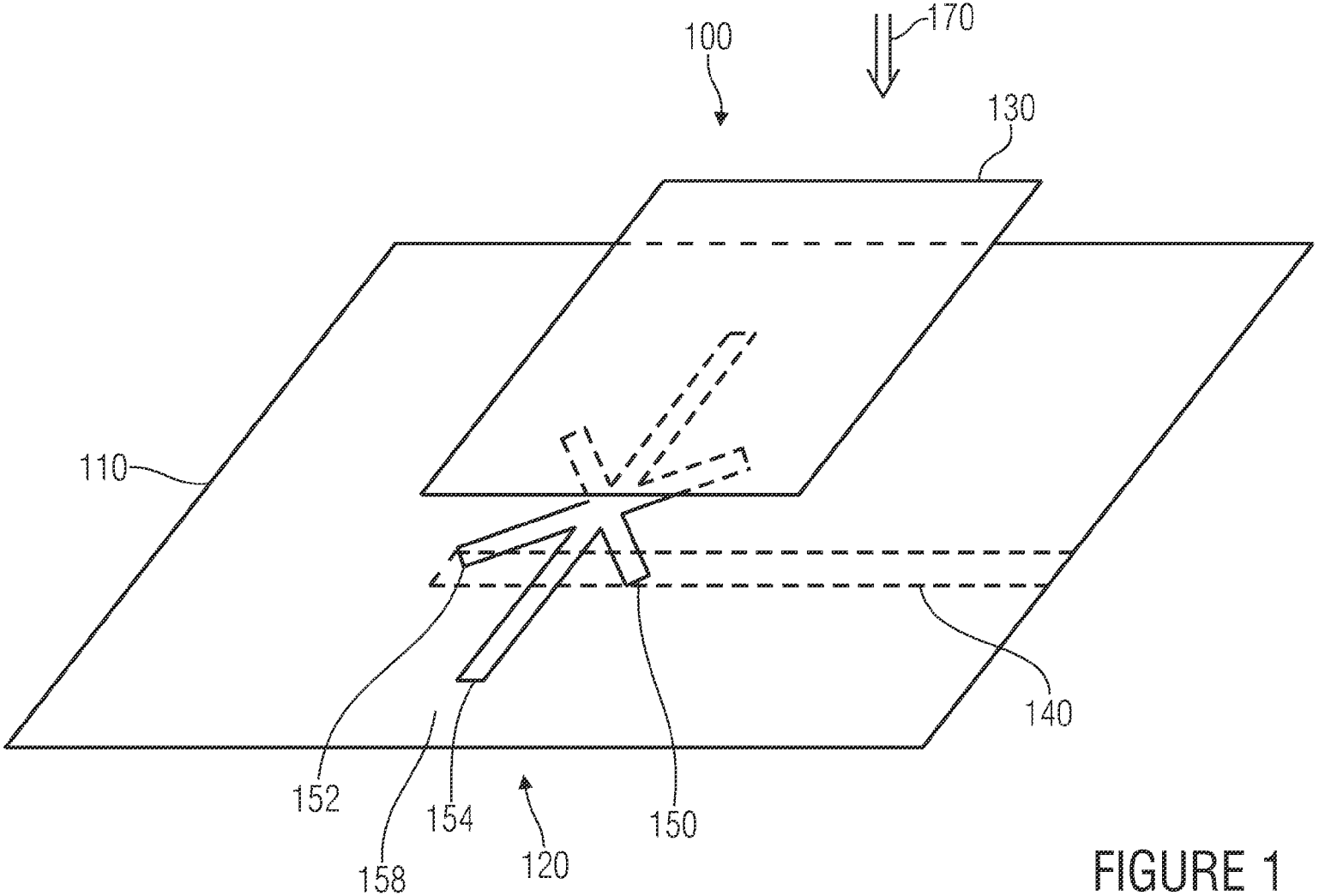
FIG. 1 shows a tilted image of an inventive antenna structure according to a first embodiment of the present invention.

FIG. 1 shows a tilted image of an inventive antenna structure according to a first embodiment of the present invention. The antenna structure in its entirety is referred to by 100. The antenna structure 100 includes a ground area 110 comprising an aperture 120. In addition, the antenna structure includes a radiation electrode 130 arranged above the ground area 110. A feeding line 140 which is shown here as a conducting strip is arranged below the ground area 110. The aperture 120 includes a first slot 150, a second slot 152 and a third slot 154. The first, second and third slots 150, 152, 154 each have a rectangular shape and represent an opening of the ground area 110. The first slot 150 and the second slot 152 are arranged so as to form a cross. The lengths of the first slot 150 and the second slot 152 in the embodiment shown are equal. The third slot 154 is longer than the first slot 150 and the second slot 152 and intersects the first and second slots 150, 152 in the region in which the first and second slots 150, 152 also intersect, i.e.

in the center of the cross formed by the first and second slots. In addition, it is to be pointed out that the third slot 154 in a top view, along a direction shown by an arrow 170, is perpendicular to the feed line 140. Furthermore, the aperture 120 comprises a high degree of symmetry. The geometrical centers of the first, second and third slots 150, 152, 154, except for manufacturing tolerances, coincide. In addition, there is axis symmetry of the aperture relative to an axis 158 of the third slot 154. In addition, the aperture 120 is arranged relative to the feed line 140 such that the feed line 140, in top view, passes through the region in which the first, second and third slots 150, 152, 154 intersect.

The radiation electrode 130 is a planar conductive electrode which may also be referred to as patch. In the embodiment shown it is arranged above the aperture 120. The radiation electrode 130 shown is basically rectangular. The radiation electrode 130 is implemented to allow a circularly polarized electromagnetic wave to be radiated. In the embodiment shown, the radiation electrode is nearly squared. However, it is also possible to use a rectangular radiation electrode in which at least one corner is bevelled and/or cut off. Also, a radiation electrode comprising a slot in the center which allows circular polarization can be used. Finally, different geometries may be used, as long as it is ensured that they allow circular polarization. The radiation electrode 130 is arranged such that the aperture 120, in a top view, along a direction characterized by the arrow 170 is symmetrical below the radiation electrode 130.

Furthermore, it is to be pointed out that, all in all, the wave guide and the radiation electrode are arranged such that energy from the wave guide can be coupled through the aperture to the radiation electrode (patch).

The mode of functioning of the present antenna structure can be described easily. The aperture 120 forms an inventive resonant cross-aperture. The first slot 150 and the second slot 152 form a slot in the shape of a cross. The slots are dimensioned such that no resonance of the cross-shaped slot occurs in the operating frequency range of the antenna. Thus, it is achieved that an oscillation resulting in a circularly polarized electromagnetic wave to be radiated is excited on the radiation electrode. The cross-shaped form of the first and second slots 150, 152 of the aperture 120 contributes to exciting a suitable mixed vibrational mode allowing such a circular polarization of the waves radiated. The third slot 154 is operated close to its resonance so that it contributes to improving the matching of the antenna described. As is shown, the third slot 154 is typically longer than the first and second slots 150, 152, wherein the slot 154 is operated closer to resonance that the first and second slots. Furthermore, it is to be pointed out that it is amazing that the third slot 154 does not interfere in the circular polarization of the electromagnetic wave radiated, as might be expected according to conventional theories.

The geometry shown can be changed in a wide range without deviating from the central ideas of the present invention. Exemplarily, lengths of the three slots 150, 152, 154 which form the aperture 120 can be altered. Exemplarily, the length of the third slot 154 can be increased or reduced. In addition, it is not necessary for the first slot 150 and the second slot 152 to have the same length. Rather, the lengths of the slots 150, 152, 154 relative to one another can be changed to allow fine adjustments of the inventive antenna structure. It is furthermore also possible to deviate from the strict symmetry of the aperture. This may, for example, be useful when the radiation electrode 130 has no complete symmetry either. With regard to the angles between the slots and between a slot and the feed line, alterations may also be made. Rotation of the slots by up to 20 degrees is possible to allow fine tuning of the antenna structure. Thus, the angle between the first slot and the second slot can deviate from a right angle by up to 20 degrees. This is similarly also true for the angle between the third slot and the feed line.

The radiation electrode 130 can be changed over a wide range. It may, for example, be rectangular or nearly rectangular. It is of advantage to use a radiation electrode which is nearly squared, wherein the dimensions and/or edge lengths differ slightly. Such a radiation electrode allows a circularly polarized electromagnetic wave to be radiated. It is also possible to use a radiation electrode which has a nearly rectangular or squared shape, wherein at least one corner is bevelled. In this case, it is also of advantage for reasons of symmetry to bevel two opposite corners. Finally, a radiation electrode which comprises a slot in the center can be used, wherein the slot thus is implemented such that a circularly polarized wave can be radiated. Conventional extensions are possible, like, for example, coupling additional metallic elements to the radiation electrode 130. In addition, parasitic elements, of, for example, a capacitive, conductive or resistive type, can be coupled to the radiation electrode 130. Thus, a desired mode forming can be forced. Apart from that, the bandwidth of the antenna can be improved by parasitic elements. Finally, it is possible to cut off and/or bevel corners of the radiation electrode 130. The result is coupling of different vibrational modes between the radiation electrode 130 and the ground area 110. As a consequence, a suitable phase shift is made between the different modes so that a right-hand circular polarization or left-hand one can be set. In addition, the radiation electrode may also be altered differently, exemplarily by adding slots to the radiation electrode which suppress undesired modes or provide for a suitable phase relation between the desired modes.

Feeding the antenna structure shown can take place in different ways. The metallic strip conductor 140 shown here can be replaced by different wave guides. Exemplarily, these wave guides may be a microstrip line. In addition, a coplanar wave guide can be used. Additionally, electrical energy can also be fed by a strip line, a dielectric wave guide or a cavity wave guide.

Additionally, it is pointed out that FIG. 1 merely represents a schematical illustration of the basic structure of an inventive antenna. Characteristics which are not essential for the antenna are not illustrated here. Thus, it is to be pointed out that the metallic structures shown, in particular the ground area 110, the radiation electrode 130 and the strip line 140, are typically supported by dielectric materials. It is possible to introduce nearly any layers or structures of dielectric materials into the antenna structure 100 shown. Structures of this kind may, for example, be layers parallel to the ground area 110. The conducting structures may be deposited on these dielectric layers and may have been patterned by a suitable method, exemplarily an etching method. The only prerequisite here is that the dielectric constant of a dielectric layer be not too large since this increases losses resulting in the antenna structure, and radiation is deteriorated. In addition, when introducing dielectric structures, it must be kept in mind that no surface waves should be excited, since they, too, also deteriorate the radiation efficiency of an antenna structure considerably.

A dielectric layer may, for example, be arranged between the ground area 110 and the strip conductor 140, the result being a microstrip line. Such a microstrip line is of particular advantage for coupling an inventive antenna structure described. In addition, a microstrip line can also be combined particularly well with active and passive circuit structures.

Dielectric structures of different shapes are also possible apart from planar dielectric structures. Exemplarily, the radiation electrode 130 can be supported by a spacer made of a dielectric material. Such a design improves the mechanical stability of the inventive antenna and allows cheap manufacturing.

A combination of dielectric layers and layers of very low dielectric constant, such as, for example, air layers, is also possible. Air layers reduce electrical losses and may reduce surface waves excited.

Figure 2:
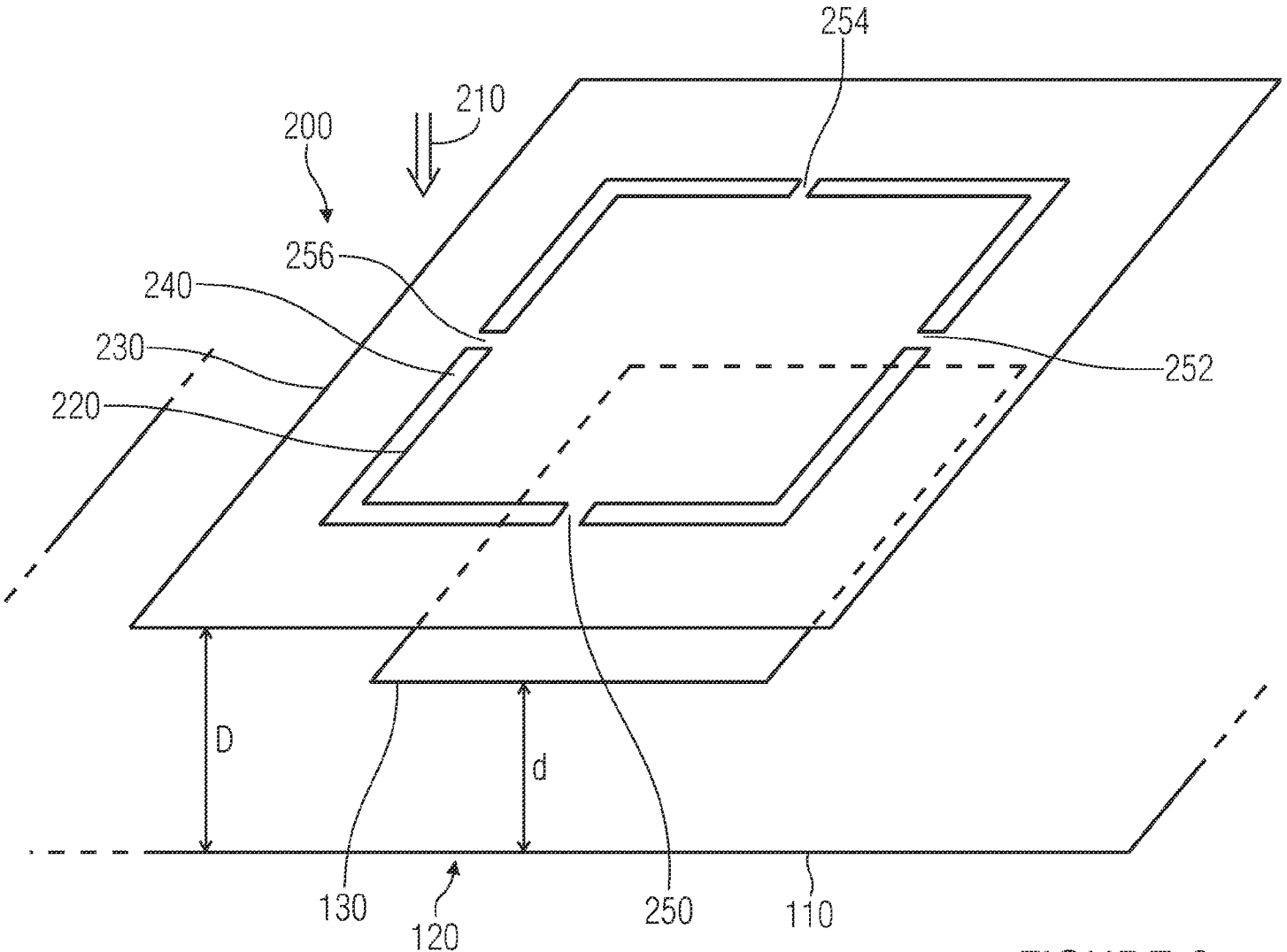
FIG. 2 shows a tilted image of an inventive radiator geometry according to a second embodiment of the present invention.

FIG. 2 shows a tilted image of an inventive radiator geometry according to a second embodiment of the present invention. The radiator geometry in its entirety is referred to by 200. It is pointed out that in FIGS. 1 and 2 and also in the remaining figures, same reference numerals refer to same means. A ground area 110 comprising an aperture 120 is shown here. Specific details of the aperture are not shown here for reasons of clarity, however the aperture corresponds to the one described and shown in FIG. 1. Additionally, the inventive radiator geometry 200 includes a first radiation electrode 130. The aperture 120 represents an opening in the ground area 110 which in a top view along a direction characterized by the arrow 210 is below the first radiation electrode 130. A second radiation electrode 220 is arranged above the first radiation electrode. It is enclosed by the third radiation electrode 230, wherein there is a gap 240 between the second radiation electrode 220 and the third radiation electrode 230. The second radiation electrode 220 is connected to the third radiation electrode 230 via four conductive lands 250, 252, 254, 256. These lands in the implementation shown are arranged roughly in the center of the edges of the second radiation electrode 220. The second radiation electrode 220 is thus arranged such that the first radiation electrode 130 is between the second radiation electrode 220 and the ground area 110. In the embodiment shown, the second radiation electrode 220 and the third radiation electrode 230 additionally are in a common plane. Furthermore, the dimensions of the second radiation electrode 220 differ only slightly from the dimensions of the first radiation electrode 130. Advantageously, the deviation is less than 20%.

Based on the structural description, the mode of functioning of an inventive radiator geometry will be explained in greater detail below. It is pointed out that such a geometry allows setting up circularly polarized dual- and/or multiband antennas. The individual layers can be supported by different boards. Exemplarily, a first board of a dielectric material can support the ground area 110, whereas a second board supports the first radiation electrode 130 and a third board supports the second radiation electrode 220 and the third radiation electrode 230. The boards, however, are not shown here for reasons of clarity, but may be arranged such that the respective radiation electrodes are supported by any board surface. At the bottom of a printed circuit board supporting the ground area 110, there may be a microstrip line from which power is transferred through the aperture 120 in the ground area first to a smaller patch formed by the first radiation electrode 130. The smaller patch formed by the first radiation electrode 130 is designed for the upper frequency band of two frequency bands. The power coupled by the aperture can subsequently be coupled onto a larger patch which is designed for the lower one of two frequency bands. The larger patch effectively includes two patches which in the embodiment shown are formed by the second radiation electrode 220 and the third radiation electrode 230. The larger patch here may be interpreted as two patches within each other having short circuits. The inner smaller patch formed by the second radiation electrode 220 is approximately as large as the bottom smaller patch formed by the first radiation electrode 130. Conductive connection lands 250, 252, 254, 256 connect the second radiation electrode 220 and the third radiation electrode 230. Depending on their positions, the connecting lands 250, 252, 254, 256 act on the second radiation electrode and the third radiation electrode as capacitive or inductive load and/or coupling, thereby having an effect on the resonant frequency of the upper radiator formed by the second radiation electrode 220 and the third radiation electrode 230. A change in the position of a connecting land 250, 252, 254, 256 (relative to the second and third radiation electrodes 220, 230 and relative to the remaining connective lands) can thus be used for fine tuning of the antenna structure. Exemplarily, it is possible to move the connecting lands 250, 252, 254, 256 from the center of the edges of the second radiation electrode 220 towards the corners of the second radiation electrode 220. In case two corners of the second radiation electrode 220 are bevelled, it has proven to be of advantage to move the connecting lands 250, 252, 254, 256 towards these bevelled and/or cut corners. In addition, it is to be pointed out that the connecting lands need not be arranged in a strictly symmetrical manner. Rather, it is practical to arrange the connecting lands 250, 252, 254, 256 at opposite edges of the second radiation electrode slightly offset so that a connecting line between two opposite connecting lands 250, 252, 254, 256 is not parallel to an edge of the second radiation electrode. Particularly great freedom when fine tuning the upper radiator results from such an asymmetrical arrangement. Finally, it should be pointed out that the connecting lands may also be omitted when there is sufficient near-field coupling between the second radiation electrode 220 and the third radiation electrode 230.

The inventive structure thus effectively includes two radiative structures, namely a so-called lower patch which is formed by the first radiation electrode 130 and is particularly effective at higher frequencies, and an upper, larger patch which is formed by the second radiation electrode 220 and the third radiation electrode 230.

It is additionally to be pointed out that the distance between the small patch formed by the first radiation electrode 130 and the ground area is smaller than the distance between the second larger patch formed by the second radiation electrode 220 and the third radiation electrode 230, and the ground area 110.

An inventive structure offers considerable advantages compared to known structures, wherein a circularly polarized radiation can be achieved in two frequency bands without considerably influencing the purity of polarization or without exciting surface waves to a greater extent.

It is pointed out here that generally an increase in an electrical substrate thickness results in higher-order surface waves forming. When surface waves of this kind form, the antenna gain is reduced strongly. In order to avoid and/or keep low the formation of surface waves, the two antenna structures contained in an inventive geometry have different effective substrate thicknesses for different frequency ranges. At lower frequencies, the upper, larger patch formed by the second radiation electrode 220 and the third radiation electrode 230 is effective. The effective substrate thickness equals the distance of the second and third radiation electrodes from the ground area 110. This distance is indicated here by D. However, at higher frequencies, the lower, small patch formed by the first radiation electrode 130 becomes effective. The effective substrate thickness equals the distance between the first radiation electrode 130 and the ground area 110 which is indicated here by d.

It shows that the effective substrate thickness for low frequencies referred to by D is larger than the effective substrate thickness for higher frequencies referred to by d This corresponds to the requirement that antennas for different frequencies must have different substrate thicknesses. Due to the fact that the radiators effective at different frequencies are in different planes and in different distances to the ground area 110, the generation of surface waves is reduced effectively. The very requirement that the effective substrate thickness be smaller for high frequencies than for low frequencies is met.

In addition, the requirement that the antenna for the upper frequency band (formed by the first radiation electrode 130) must be closer to the ground area 110 and to the aperture 120 than the antenna for the lower frequency band (formed by the second radiation electrode 220 and the third radiation electrode 230) is met by means of the inventive geometry. If the larger patch were at the bottom (i.e. close to the aperture) and the smaller patch at the top (i.e. remote from the aperture), this would result in poor polarization characteristics in the upper frequency range, since the aperture would be shielded by the larger patch. In such a case, effective coupling of the small patch through the aperture would not longer be possible. Correspondingly, a smaller patch separated from the aperture by a larger patch would not be able to radiate a circularly polarized wave with a low portion of orthogonal polarization.

In addition, it is avoided by the inventive geometry in which the larger patch is composed of two parts, namely the second radiation electrode 220 and the third radiation electrode 230, that the radiation of the bottom smaller patch is shielded too strongly by the upper larger patch. When the antenna for the upper frequency band is closer to the ground area 110 than the antenna for the lower frequency band, the strong shielding of the small radiator by the large one should be avoided.

Reduced shielding of the radiation of the lower patch 130 by the upper patch 220, 230 is achieved by the gap 140 between the second radiation electrode 220 and the third radiation electrode 230.

The inventive radiator geometry 200 can also be changed considerably. All the alterations described before can be applied to the individual radiation electrodes 130, 220, 230. Exemplarily, it is of advantage to cut the corners of the corresponding radiation electrodes. Several modes necessary for circular radiation can be coupled, while undesired modes can be suppressed.

Figure 3:
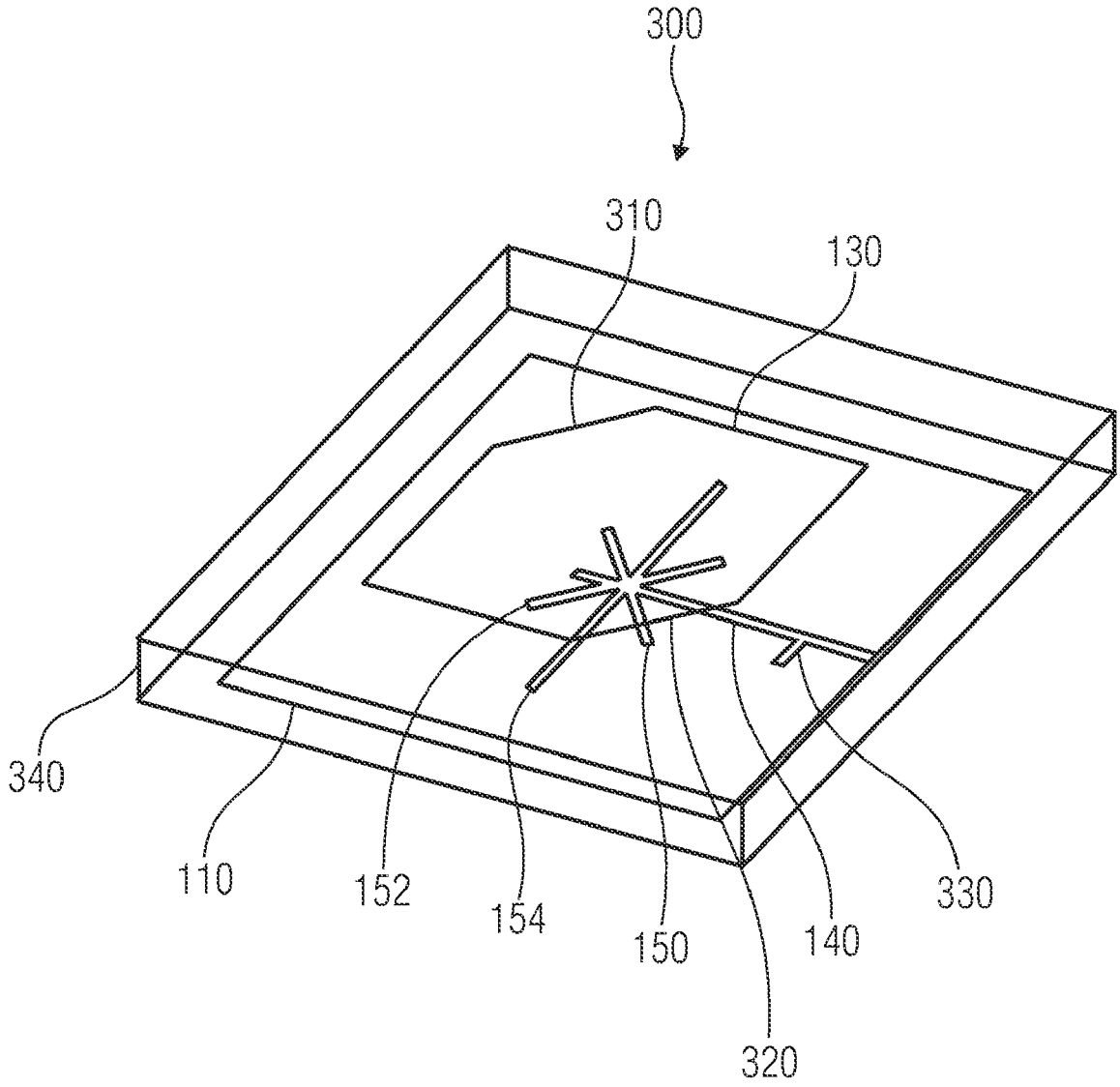
FIG. 3 shows a tilted image of an inventive antenna structure according to a third embodiment of the present invention.

FIG. 3 shows a tilted image of an inventive antenna structure according to a third embodiment of the present invention. The antenna structure in its entirety is referred to by 300. It basically corresponds to the antenna structure 100 shown referring to FIG. 1, so that same means and geometry characteristics here are provided with same reference numerals. Unchanged characteristics will not be described again. However, it is pointed out that in the antenna arrangement 300 a first corner 310 and a second corner 320 of the first radiation electrode 130 are cut off and/or bevelled. This geometrical alteration contributes to the fact that a circularly polarized electromagnetic wave can be radiated. In addition, the antenna arrangement 300 comprises a stub 330 applied to the strip line 140. This stub 330 serves further impedance matching of the present antenna structure. The dimensioning of such a stub for matching is known to one skilled in the art.

In addition, FIG. 3 shows an enclosing cuboid 340 enclosing the entire antenna structure. Such an enclosing cuboid may, for example, be used to delineate a simulation region in an electromagnetic simulation of an antenna structure.

Figure 4:
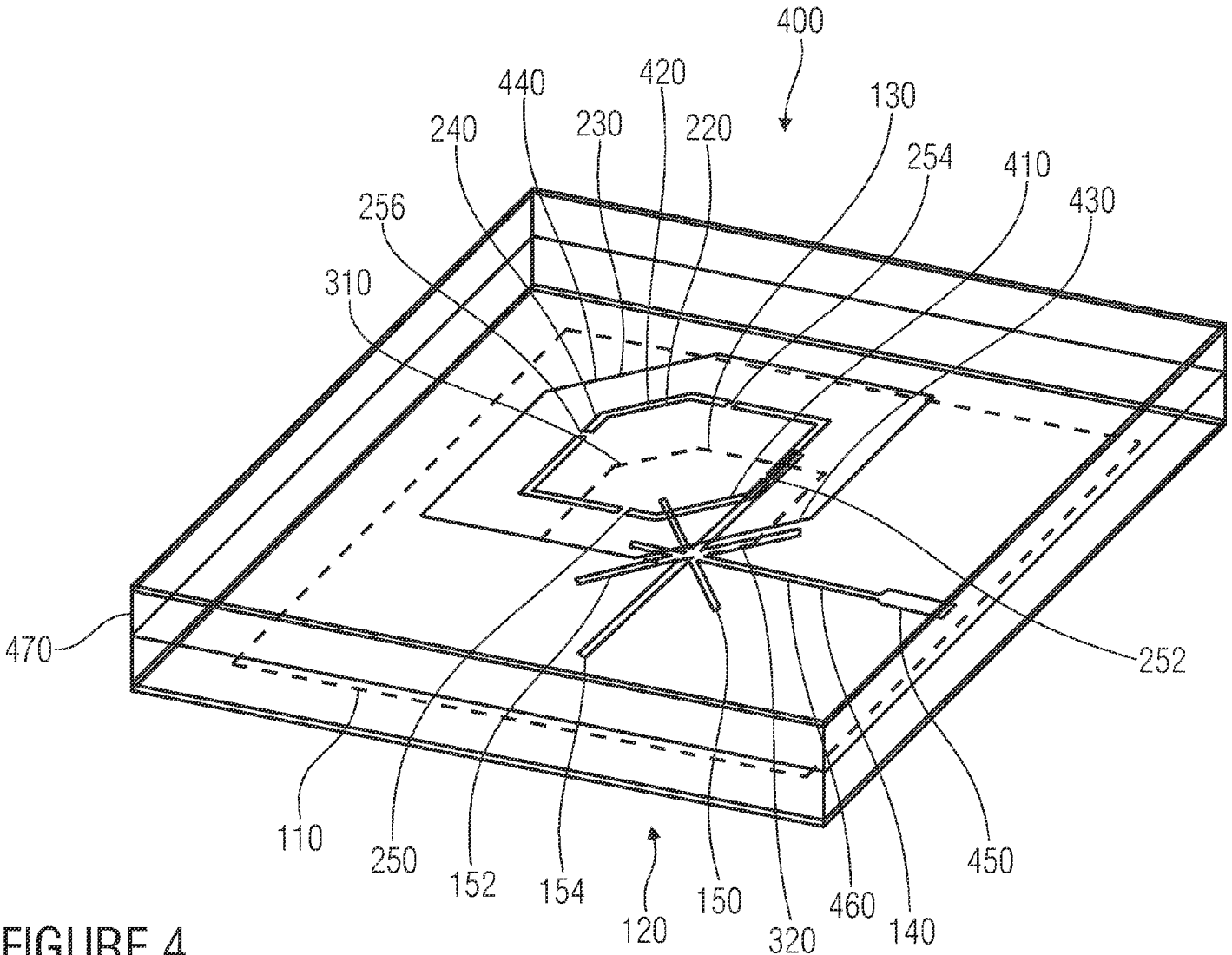
FIG. 4 shows a tilted image of an inventive antenna structure according to a fourth embodiment of the present invention.

FIG. 4 shows a tilted image of an inventive antenna structure according to a fourth embodiment of the present invention. The antenna structure in its entirety is referred to by 400. The antenna structure 400 includes a feed line 140, a ground area 110 having an aperture 120, and a first radiation electrode 130, a second radiation electrode 220 and a third radiation electrode 230. The geometry of the first radiation electrode 130 here basically corresponds to the geometry of the first radiation electrode 130 shown in FIG. 3. The second and third radiation electrodes 220, 230 are basically arranged as is described referring to FIG. 2. However, in the antenna structure 400, two opposite corners 410, 420 of the second radiation electrode 220 are bevelled. The third radiation electrode 230 in turn encloses the second radiation electrode 220, wherein there is a slot and/or gap 240 between the second radiation electrode 220 and the third radiation electrode 230. Additionally, it is to be pointed out that the third radiation electrode 230 in its shape is adjusted to the second radiation electrode 220. This means that the third radiation electrode 230 is adjusted to the bevelled corners 410, 420 of the second radiation electrode 220 such that the gap 240 between the second radiation electrode 220 and the third radiation electrode 230 basically has an equal width also in the region of the bevelled corners 410, 420. The inner edges of the third radiation electrode 230 thus are basically parallel to the external edges of the second radiation electrode 220. The third radiation electrode 230, too, comprises two external bevelled corners 430, 440 which are adjacent to the bevelled corners 410, 420 of the second radiation electrode 220. Thus, both the first, second and third radiation electrodes 130, 220, 230 comprise bevelled corners 310, 320, 410, 420, 430, 440, wherein the respective adjacent corners of the different radiation electrodes are bevelled. The second and third radiation electrodes 220, 230 are coupled via connecting lands 250, 252, 254, 256, wherein the connective lands 250, 252, 254, 256 are arranged roughly in the center of edges of a rectangle representing the second radiation electrode 220, except for the bevelled corners.

In addition, it is pointed out that the size of the second radiation electrode 220, except for a deviation of at most 20%, equals the size of the first radiation electrode 130. As to the shape, too, the first and second radiation electrodes 130, 220 do not differ considerably. Thus, they are nearly parallel electrodes of nearly equal shape having nearly the same dimensions.

The layer sequence is explicitly pointed out here again. The feed line 140 forms the bottommost conducting layer. A ground area 110 comprising an aperture 120 is arranged above it. The first radiation electrode 130 is arranged above this in one plane. The second radiation electrode 220 and the third radiation electrode 230 are arranged in another plane further up. The respective metallizations, i.e. the feed line 140, the ground area 110 and the first, second and third radiation electrodes 130, 220, 230, are each supported by dielectric layers.

Additionally, it is mentioned here that the width of the feed line 140 is changed for adjusting purposes. The feed line 140, away from the aperture, has a broad portion 450, whereas the feed line 140 is narrower close to the aperture. A narrow feed line is of advantage since it causes a greater concentration of the electrical field. Thus, a stronger coupling of the radiation electrodes can occur to the feed line through the aperture 120. Furthermore, the change in the width of the feed line also serves impedance matching, wherein matching can be influenced by suitably choosing the length of the thin piece 460.

Also shown is an enclosing rectangle 470 which delineates a simulation region in which the antenna structure is simulated. The enclosing rectangle also indicates the thickness of the respective layers.

Figure 5:
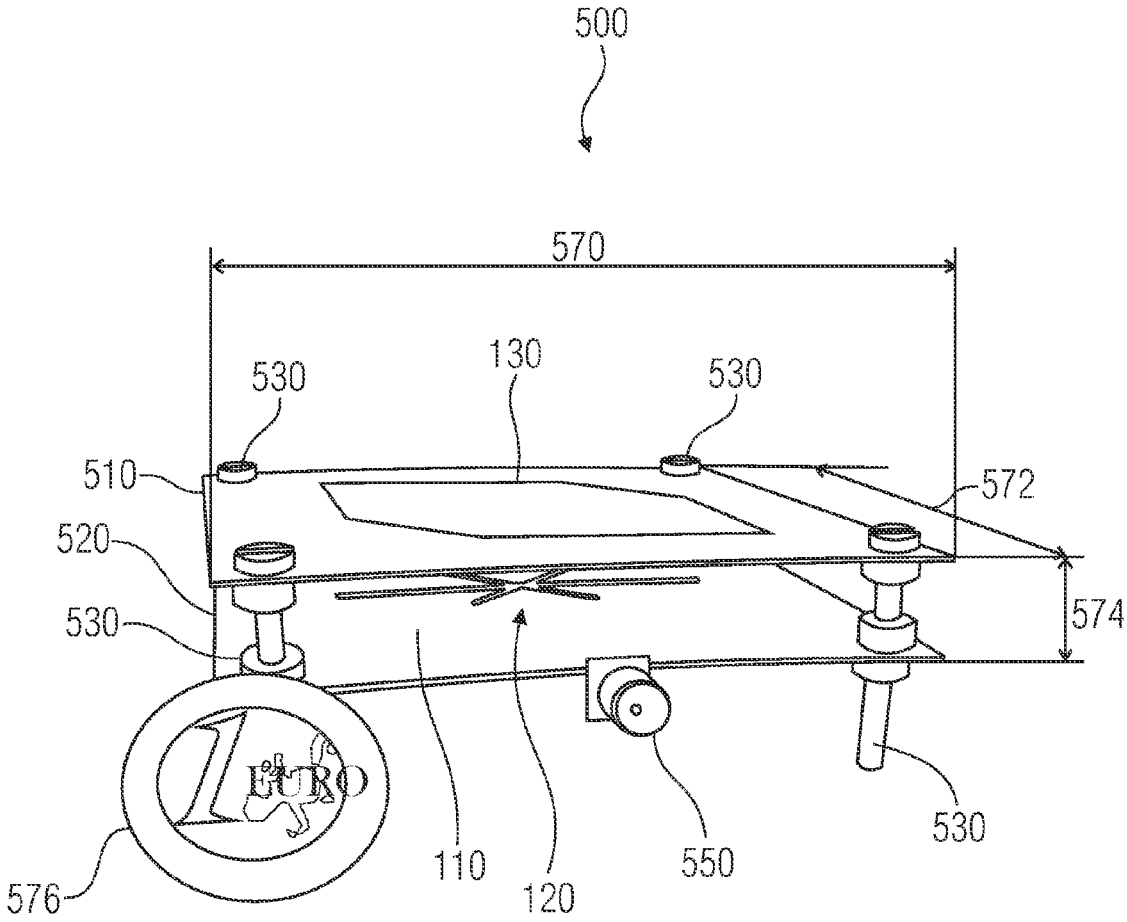
FIG. 5 shows a photograph of a prototype of an inventive antenna structure according to the third embodiment of the present invention.

FIG. 5 shows a photograph of an inventive planar antenna structure prototype according to a third embodiment of the present invention. A constructed monoband antenna is shown here, designed for the frequency range from 2.40 GHz to 2.48 GHz. The antenna in its entirety is referred to by 500. It comprises a first board 510 made of a dielectric material and a second board 520 made of a dielectric material. The two boards are separated and/or fixed by four spacers 530 made of a dielectric material. The first dielectric board 510 supports a first radiation electrode 130. The second dielectric board 520 supports, on an upper area, the ground area 110 comprising an aperture 120. The lower side of the dielectric board 530 supports a feed line via which electrical energy is fed to the antenna from an SMA socket 550.

The antenna arrangement 500 has a first dimension 570 of 75 mm which can be taken as a width. A second dimension 572 which can be taken as a length is also 75 mm. Finally, a third dimension 574 which can be taken as a height is 10 mm. Just for size comparison purposes, a one Euro coin 576 is shown here.

Figure 6:
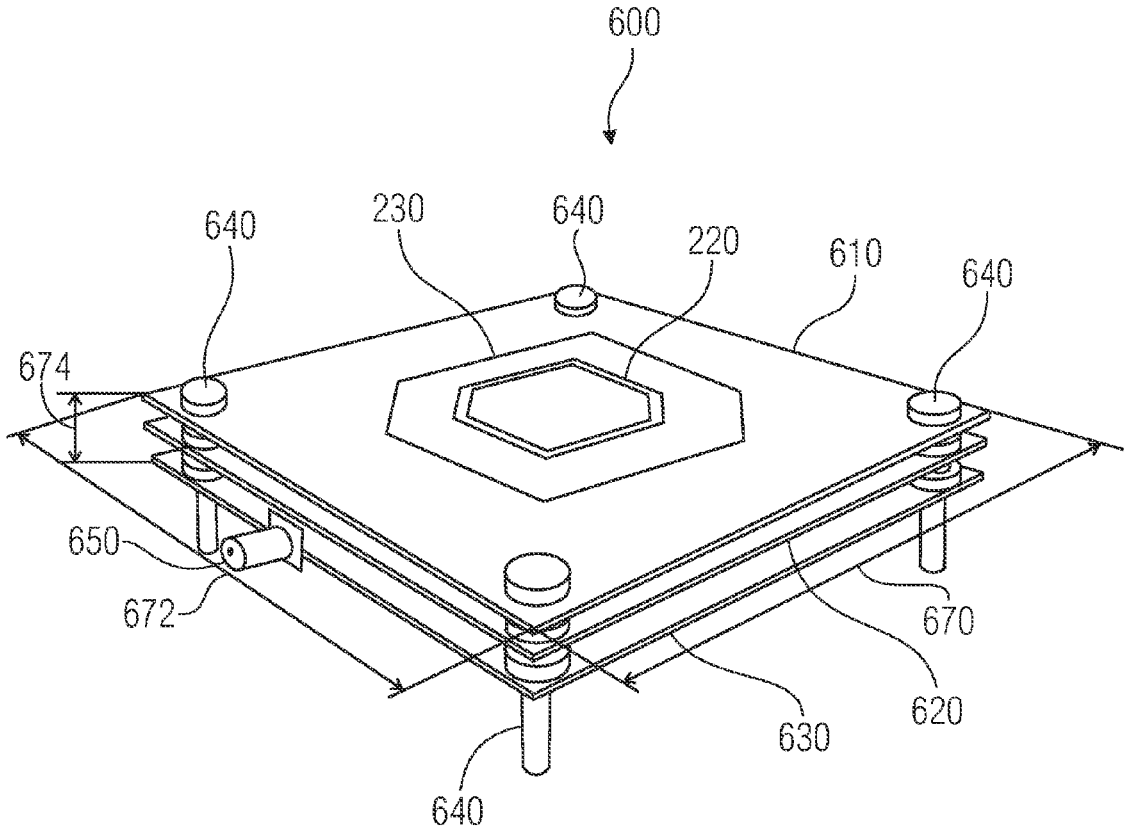
FIG. 6 shows a photograph of a prototype of an inventive antenna structure according to the fourth embodiment of the present invention.

FIG. 6 shows a photograph of a prototype of an inventive antenna structure according to the fourth embodiment of the present invention. The antenna structure in its entirety is referred to by 600. It includes a first dielectric layer 610, a second dielectric layer 620 and a third dielectric layer 630.

The 3 dielectric layers or boards 610, 620, 630 are supported by dielectric spacers 640. The first dielectric board 610 here supports a second radiation electrode 220 and a third radiation electrode 230. The second dielectric board supports a first radiation electrode 130. The third dielectric board 630 supports a ground area 110 on one side and a feed line 140 on the other side. The feed line is also led out to an SMA socket 650. The entire antenna structure 600 forms a dual-band antenna.

The antenna 600 has a first dimension 670 which can also be taken as a length. This first dimension is 75 mm. In addition, the antenna 600 has a second dimension 672 which can be taken as a width which is also 75 mm. A third dimension 674 of the antenna 600 can be taken as a height. This height is 10.5 mm.

The dual-band antenna 600 shown is based on the monoband antenna 500, wherein the monoband antenna has been improved to form a dual-band antenna. The antenna 600 which in its principle setup corresponds to the antenna 400 shown in FIG. 4 is set up of several layers which will be discussed in greater detail below. The bottommost sheet of the antenna is formed by a patterned conductive layer, exemplarily a metallization layer and/or metal layer which as a whole forms a microstrip line. This microstrip line is deposited on the bottom side of a first substrate of the type FR4, wherein the first substrate has a thickness of 0.5 mm. The first substrate corresponds to the third dielectric layer 630. A ground area having an overall extension of 75 mm×75 mm is deposited on the top of the first substrate. The ground area additionally includes an aperture 120. A layer which is not filled by a dielectric material is arranged above the ground area. Correspondingly, the antenna also includes an air layer having a thickness of 5 mm. Another conductive layer on which the first radiation electrode is formed as a patch is arranged above this air layer. The further conductive layer is supported by a second dielectric layer made of FR4 which again has a thickness of 0.5 mm. The second dielectric FR4 layer corresponds to the second dielectric layer 620 shown in FIG. 6. A layer in which there is no solid dielectric is arranged above the second dielectric FR4 layer. The result is a second air layer the thickness of which is 4 mm. A third dielectric FR4 layer having a thickness of 0.5 mm is arranged above it. The third dielectric FR4 layer supports another conductive layer on which the second radiation electrode and the third radiation electrode in the form of patches are formed by patterning. Conducting connecting lands between the second radiation electrode and the third radiation electrode have a width of 1 mm. The entire antenna structure thus includes the following layers in the order shown: microstrip line; FR4 (0.5 mm); ground area (75 mm×75 mm, including aperture); air (5 mm); patch 1 (first radiation electrode); FR4 (0.5 mm); air (4 mm); FR4 (0.5 mm) and patch 2 (second radiation electrode and third radiation electrode). All the layers and dimensions can be varied by up to 30%. However, it is of advantage for the deviation from the dimensions not to be more than 15%.

Figure 7:
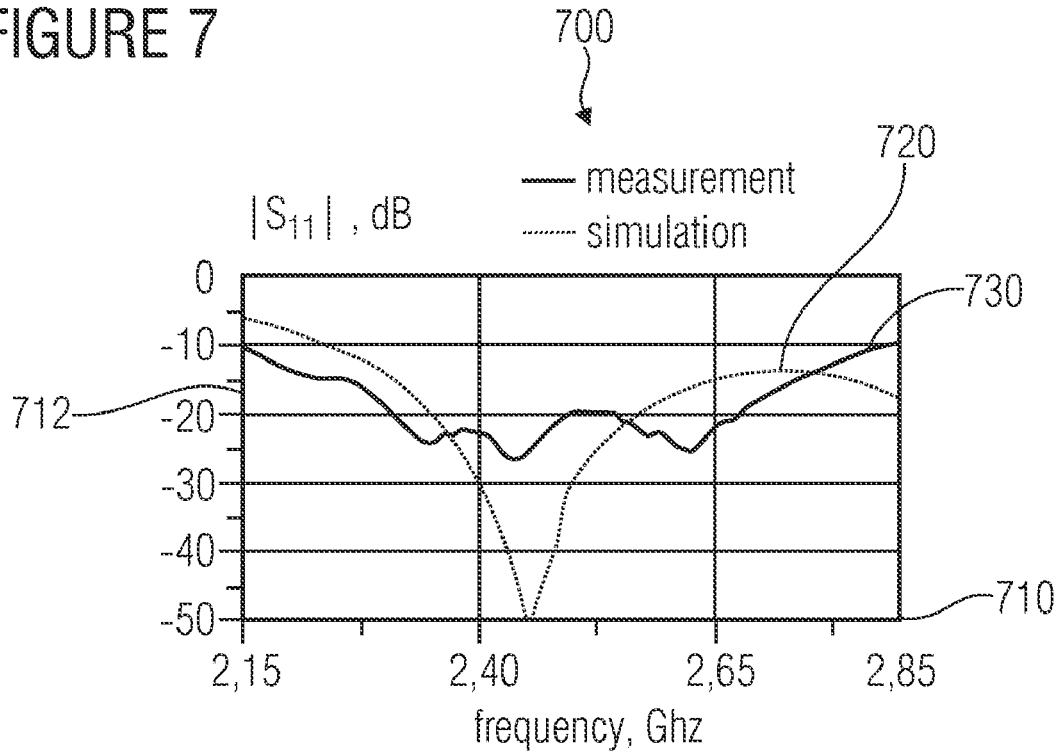
FIG. 7 shows a graphical illustration of the form of the reflection coefficient S11 for a prototype of an inventive antenna according to the third embodiment of the present invention.

FIG. 7 shows a graphical illustration of the form of the reflection coefficient S11 for a prototype 500 of an inventive antenna according to a third embodiment of the present invention. The graphical illustration in its entirety is referred to by 700. The input reflection factor S11 has been measured for a constructed patch antenna which is designed for a frequency range from 2.40 to 2.48 GHz. A photograph of such an antenna 500 is shown in FIG. 5.

The frequency of 2.15 GHz to 2.85 GHz is plotted on the abscissa 710. The ordinate 712 shows, in logarithmic style, the magnitude of the input reflection factor S11. Here, the input reflection factor is plotted in a range from −50 dB to 0 dB. A first graph 720 shows a simulated input reflection factor. A second graph 730 shows the measured value for the input reflection factor. According to the measurement, the input reflection factor is below −10 dB in the entire frequency range shown from 2.15 GHz to 2.85 GHz. The simulation, too, shows a similar broadband characteristic of the antenna.

Figure 8:
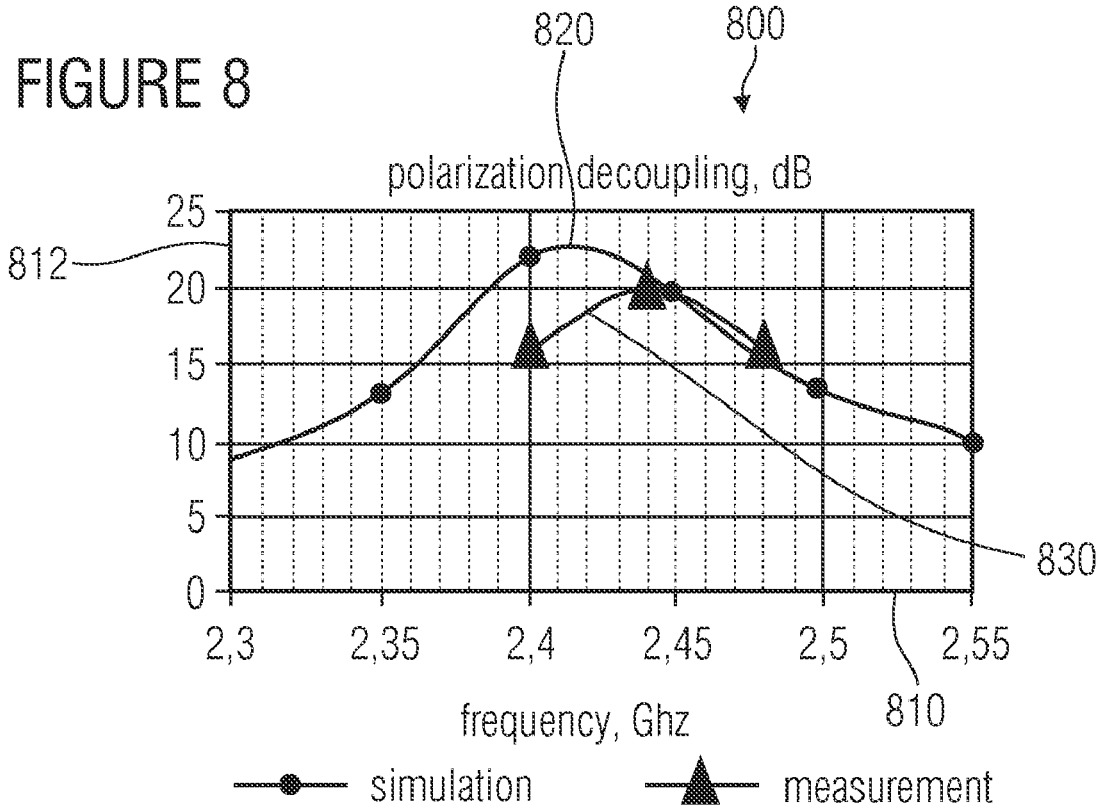
FIG. 8 shows a graphical illustration of the form of the polarization decoupling for a prototype of an inventive antenna according to the third embodiment of the present invention.

FIG. 8 shows a graphical illustration of the polarization decoupling for a prototype 500 of an inventive antenna according to the third embodiment of the present invention. The graphical illustration in its entirety is referred to by 800. The frequency in a range from 2.3 GHz to 2.55 GHz is plotted on the abscissa 810. The ordinate 812 shows the polarization decoupling in decibels in a range between 0 and 25 dB. A first graph 820 shows a simulated form of the polarization decoupling, whereas a second graph 830 shows the measured values. In the necessary bandwidth of 2.40 GHz to 2.48 GHz, the cross-polarization, with a sufficient adjusting factor, is suppressed by more than 15.5 dB.

Figure 9:
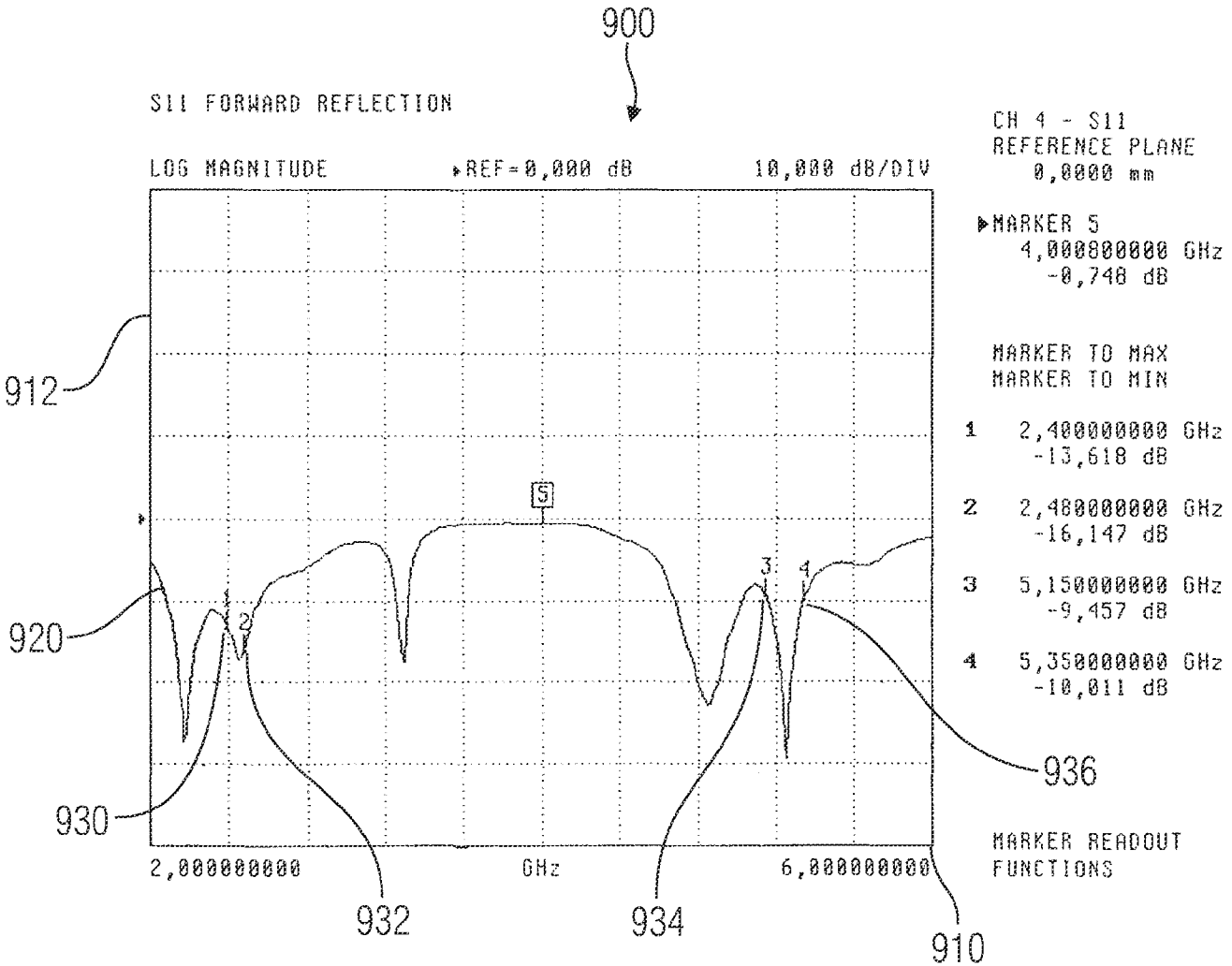
FIG. 9 shows a graphical illustration of the form of the reflection coefficient S11 for a prototype of an inventive antenna according to the fourth embodiment of the present invention.

FIG. 9 shows a graphical illustration of the form of the reflection coefficient S11 for a prototype 600 of an inventive antenna according to the fourth embodiment of the present invention. The graphical illustration in its entirety is referred to by 900. Measuring results are shown here for the reflection coefficient of an inventive dual-band antenna, as has been described referring to FIGS. 4 and 6. The abscissa 910 here shows the frequency range between 2 GHz and 6 GHz. The magnitude of the input reflection factor S11 in logarithmic style is plotted on the ordinate 912 from −40 dB to +40 dB. A graph 920 shows the form of the input reflection factor relative to frequency. Also shown are a first marker 930, a second marker 932, a third marker 934 and a fourth marker 936. The first marker shows that the input reflection factor at 2.40 GHz is −13.618 dB. The second marker shows an input reflection factor of −16.147 dB at 2.48 GHz. The third marker shows an input reflection factor of −9.457 dB at 5.15 GHz, and the fourth marker shows an input reflection factor of −10.011 dB at 5.35 GHz. The fifth marker finally shows an input reflection factor of −0.748 dB at 4.0008 GHz.

It shows that the input reflection factor in the ISM band between 2.40 GHz and 2.48 GHz is less than −13 dB and that the input reflection factor in the ISM band between 5.15 GHz and 5.35 GHz is less than −9.4 dB.

Apart from the input reflection factor, the radiation characteristics of the dual-band antenna were also measured. In the ISM band between 2.40 GHz and 2.48 GHz, the antenna gain of a prototype of a dual-band antenna is between 7.9 dBic and 8.3 dBic. The half-width is here 70° and the polarization decoupling is between 11 dB and 22 dB.

In the ISM band between 5.15 GHz and 5.35 GHz, the antenna gain is between 5.9 dBic and 7.3 dBic. The half-width is 35°, the polarization decoupling is between 5 dB and 7 dB.

The necessary adjusting characteristics and radiation characteristics can be achieved by an inventive dual-band antenna. Furthermore, it is to be mentioned that the polarization purity for the upper frequency range can still be optimized. Geometrical details may, for example, be altered.

In summary, it can be stated that the present invention provides a planar circularly polarized antenna which may be used in the ISM bands of 2.40 GHz to 2.48 GHz and 5.15 GHz to 5.35 GHz. The suggested shape of the slot for an aperture-coupled patch antenna allows radiating nearly purely circularly polarized waves at a relatively large bandwidth of the reflection coefficient S11. This is in particular also possible for multiband antennas. A radio link can be achieved by an inventive antenna, wherein the intensity of the signal received by an inventive antenna at a linear polarization of a transmitter is independent of the insertion position of the receive antenna. Put differently, a linearly polarized signal can be received by a circularly polarized antenna, independently of the orientation of the antenna.

The inventive antenna has been developed in several steps. A first sub-task was developing an aperture-coupled antenna for a frequency range of 2.40 to 2.48 GHz having a right-hand circular polarization (RHCP). In simulation, it has been paid attention to that a strong suppression of the orthogonal polarization within the bandwidth necessary is achieved. Thus, it has been found out that cross-polarization is suppressed strongly when feeding a patch through a non-resonant cross-aperture. However, in such a non-resonant cross-aperture, the bandwidth of the reflection coefficient is narrow. A resonant rectangular aperture (so-called SSFIP principle) comprises a larger bandwidth, wherein, however, polarization decoupling is weaker. Finally, a combination of the two slot geometries not known before has proven to be of advantage, which is here referred to as resonant cross-aperture. A corresponding antenna geometry has been shown in FIGS. 1, 3 and 5.

Furthermore, it has shown that an inventive geometry shown of the aperture and/or the slot also allows setting up circularly polarized dual- and/or multiband antennas. The concept to be described below may be used here. In the case of two bands, the antenna includes three boards. Corresponding arrangements are, for example, shown in FIGS. 4 and 6. On the bottom side of the bottom printed circuit board, there is a microstrip line the power of which couples through an aperture in the ground area first to a small patch (for the upper frequency band) and then a larger patch (for the two frequency bands) including two patches. Thus, the larger patch can be interpreted as "two patches within each other having short circuits". The inner smaller patch has the same size as the bottom patch.

A number of problems occurring in conventional antennas can be solved by such a structure and/or such a dual-band concept. Increasing the electrical substrate thickness conventionally results in higher-order surface waves forming, thereby strongly reducing the antenna gain. Thus, the two antennas must have different substrate thicknesses for different frequency ranges. The antennas for different frequency ranges consequently have to be in different planes. This can be achieved by means of an inventive antenna geometry.

A conventional variation with a larger bottom patch and a smaller top patch comprises poor polarization characteristics, since the aperture is shielded by the larger patch. The antenna for the upper frequency band consequently has to be closer to ground than the antenna for the lower frequency band, which can be achieved by an inventive geometry.

Since the antenna for the upper frequency band thus must be closer to the ground area than the antenna for the lower frequency band, strong shielding of the small radiator for the upper frequency band by the large radiator for the lower frequency band should be avoided. This can be achieved by forming the radiator for the lower frequency band by two radiation electrodes between which there is a gap.

Adjusting an inventive antenna can be performed by a transformer and/or a stub.

Compared to conventional antennas, an inventive antenna has a number of advantages. Feeding an antenna through a resonant cross slot allows setting up completely planar, relatively small and cheap antennas. At the same time, high polarization purity and large impedance bandwidth can be achieved. In addition, planar circularly polarized multiband antennas can be constructed. Thus, the area consumption of the entire antenna is determined only by the size of the antenna element for the lowest frequency. Compared to broadband antennas, an inventive antenna still offers better pre-filtering.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. An aperture-coupled antenna comprising:

a first radiation electrode the geometrical shape of which is implemented to allow radiation of a circularly polarized electromagnetic wave;

a ground area; and a wave guide which is implemented to supply energy to the antenna, wherein the wave guide is arranged spaced apart from the ground area on a first side of the ground area, and wherein the first radiation electrode is arranged spaced apart from the ground area on a second side of the ground area;

wherein the ground area comprises an aperture including a first slot in the ground area, a second slot in the ground area and a third slot in the ground area, wherein the first slot and the second slot together form a slot in the shape of a cross, wherein the third slot passes through an intersection of the first slot and the second slot;

wherein additionally the wave guide and the first radiation electrode are arranged such that energy can be coupled from the wave guide through the aperture to the first radiation electrode;

wherein the third slot is implemented such that an operating frequency for which the aperture-coupled antenna is designed deviates by at most 30% from a resonant frequency of the third slot; and wherein the length of the first slot and the length of the second slot differ from the length of the third slot to allow the third slot at the operating frequency to be operated nearer to its resonance than the first slot and the second slot;

wherein end portions of the first slot are spatially separated from the second slot and from the third slot;

wherein end portions of the second slot are spatially separated from the first slot and from the third slot; and wherein end portions of the third slot are spatially separated from the first slot and from the second slot.

2. The aperture-coupled antenna according to claim 1, wherein the third slot is longer than the first slot, and wherein the third slot is longer than the second slot.

3. The aperture-coupled antenna according to claim 1, wherein the first slot and the second slot are orthogonal to each other and together form a slot in the shape of a rectangular cross comprising arms of equal lengths.

4. The aperture-coupled antenna according to claim 1, wherein a midpoint of the third slot coincides with a midpoint of the cross-shaped slot formed by the first slot and the second slot.

5. The aperture-coupled antenna according to claim 1, wherein a geometrical midpoint of the first slot, a geometrical midpoint of the second slot and a geometrical midpoint of the third slot coincide, and wherein the aperture is axisymmetrical relative to an axis of the third slot, wherein the axis of the third slot passes along a greatest dimension of the third slot.

6. The aperture-coupled antenna according to claim 1, wherein the first slot and the second slot are implemented such that the first slot and the second slot do not comprise resonance in an operating frequency range for which the aperture-coupled antenna is designed.

7. The aperture-coupled antenna according to claim 1, wherein the third slot is implemented such that a resonant frequency of the third slot is within an operating frequency range for which the aperture-coupled antenna is designed.

8. The aperture-coupled antenna according to claim 1, wherein the aperture-coupled antenna is a planar antenna.

9. The aperture-coupled antenna according to claim 1, wherein the wave guide is a microstrip line, a coplanar wave guide, a strip line, a dielectric wave guide or a cavity wave guide.

10. The aperture-coupled antenna according to claim 1, wherein the aperture and the first radiation electrode are implemented such that the aperture-coupled antenna, except for parasitic effects, radiates a circularly polarized electromagnetic wave.

11. The aperture-coupled antenna according to claim 1, further comprising a second radiation electrode and a third radiation electrode, wherein the second radiation electrode is basically parallel to the first radiation electrode and arranged such that the first radiation electrode is arranged between the second radiation electrode and the ground area, and wherein the third radiation electrode encloses the second radiation electrode in a projection along an axis normal to the second radiation electrode.

12. The aperture-coupled antenna according to claim 11, wherein the second radiation electrode and the third radiation electrode are in one plane, and wherein the third radiation electrode encloses the second radiation electrode in the plane.

13. The aperture-coupled antenna according to claim 11, wherein the second radiation electrode and the third radiation electrode are coupled to each other via at least one conductive connective land.

14. The aperture-coupled antenna according to claim 11, comprising a first dielectric layer, a first layer of lower dielectric constant, and a second dielectric layer, wherein the first dielectric layer supports the wave guide on a first surface of the first dielectric layer and supports the ground area on a second surface of the first dielectric layer, wherein the second dielectric layer supports the first radiation electrode on a surface;

wherein the first layer of lower dielectric constant is arranged between the first dielectric layer and the second dielectric layer;

wherein a dielectric constant of the first layer of lower dielectric constant is smaller than a dielectric constant of the first dielectric layer, and wherein the dielectric constant of the first layer of lower dielectric constant is smaller than a dielectric constant of the second dielectric layer.

15. The aperture-coupled antenna according to claim 14, further comprising a second layer of lower dielectric constant and a third dielectric layer, wherein the third dielectric layer supports the second radiation electrode and the third radiation electrode;

wherein the second layer of lower dielectric constant is arranged between the second dielectric layer and the third dielectric layer;

wherein a dielectric constant of the second layer of lower dielectric constant is smaller than the dielectric constant of the first dielectric layer, wherein the dielectric constant of the second layer of lower dielectric constant is smaller than the dielectric constant of the second dielectric layer, and wherein the dielectric constant of the second layer of lower dielectric constant is smaller than a dielectric constant of the third dielectric layer.

16. The aperture-coupled antenna according to claim 1, comprising a first dielectric layer, a first layer of lower dielectric constant, and a second dielectric layer, wherein the first dielectric layer supports the wave guide on a first surface of the first dielectric layer and supports the ground area on a second surface of the first dielectric layer, wherein the second dielectric layer supports the first radiation electrode on a surface;

wherein the first layer of lower dielectric constant is arranged between the first dielectric layer and the second dielectric layer;

wherein a dielectric constant of the first layer of lower dielectric constant is smaller than a dielectric constant of the first dielectric layer, and wherein the dielectric constant of the first layer of lower dielectric constant is smaller than a dielectric constant of the second dielectric layer.

17. The aperture-coupled antenna according to claim 16, wherein the first or the second dielectric layer is made of FR4 material.

18. The aperture-coupled antenna according to claim 16, wherein the first layer of lower dielectric constant or the second layer of lower dielectric constant is an air layer.

19. The aperture-coupled antenna according to claim 1, which is implemented such that impedance matching can be achieved with a standing wave ratio of smaller than 2 in at least two frequency bands.

20. An aperture-coupled antenna comprising:

a first radiation electrode the geometrical shape of which is implemented to allow radiation of a circularly polarized electromagnetic wave;

a ground area; and a wave guide which is implemented to supply energy to the antenna;

wherein the wave guide is arranged spaced apart from the ground area on a first side of the ground area, and wherein the first radiation electrode is arranged spaced apart from the ground area on a second side of the ground area;

wherein the ground area comprises an aperture including a first slot in the ground area, a second slot in the ground area and a third slot in the ground area, wherein the first slot and the second slot together form a slot in the shape of a cross, wherein the third slot passes through an intersection of the first slot and the second slot;

wherein additionally the wave guide and the first radiation electrode are arranged such that energy can be coupled from the wave guide through the aperture to the first radiation electrode;

wherein the third slot is implemented such that an operating frequency for which the aperture-coupled antenna is designed deviates by at most 30% from a resonant frequency of the third slot; and wherein the length of the first slot and the length of the second slot differ from the length of the third slot to allow the third slot at the operating frequency to be operated nearer to its resonance than the first slot and the second slot.

21. An aperture-coupled antenna comprising:

a first radiation electrode, the geometrical shape of which is implemented to allow radiation of a circularly polarized electromagnetic wave;

a ground area; and a wave guide which is implemented to supply energy to the antenna;

wherein the wave guide is arranged spaced apart from the ground area on a first side of the ground area, and wherein the first radiation electrode is arranged spaced apart from the ground area on a second side of the ground area;

wherein the ground area comprises an aperture including a first slot in the ground area, a second slot in the ground area and a third slot in the ground area, wherein the first slot and the second slot together form a slot in the shape of a cross, wherein the third slot passes through an intersection of the first slot and the second slot;

wherein additionally the wave guide and the first radiation electrode are arranged such that energy can be coupled from the wave guide through the aperture to the first radiation electrode;

wherein the third slot is implemented such that an operating frequency for which the aperture-coupled antenna is designed deviates by at most 30% from a resonant frequency of the third slot; and wherein the length of the first slot and the length of the second slot differ from the length of the third slot to allow the third slot at the operating frequency to be operated nearer to its resonance than the first slot and the second slot;

wherein the third slot is longer than the first slot, and wherein the third slot is longer than the second slot;

wherein a geometrical midpoint of the first slot, a geometrical midpoint of the second slot and a geometrical midpoint of the third slot coincide, and wherein the aperture is axisymmetrical relative to an axis of the third slot, wherein the axis of the third slot passes along a greatest dimension of the third slot.

* * * * *